US005560070A

United States Patent [19]

Reaume

[11] Patent Number: 5,560,070

[45] Date of Patent: Oct. 1, 1996

[54] BRUSH

[76] Inventor: Cary S. J. Reaume, 3555 Don Mills Road, Suite 6-219, Willowdale, Ontario, Canada, M2H 3N3

[21] Appl. No.: 335,255

[22] Filed: Nov. 7, 1994

[51] Int. Cl.[6] ..... A47L 13/20

[52] U.S. Cl. ..... 15/210.1; 15/223; 15/228; 300/21

[58] Field of Search ..... 15/147.1, 208, 15/210.1, 223, 225, 228, 230.15, 150; 300/21; 604/1

[56] References Cited

U.S. PATENT DOCUMENTS

| | | | |
|---|---|---|---|
| 390,723 | 10/1888 | Thorpe | D32/40 |
| 1,047,222 | 12/1912 | Hoag | 15/223 |
| 1,111,575 | 9/1914 | Goodwin | 15/150 |
| 1,993,215 | 3/1935 | Hoyt et al. | 300/21 |
| 2,242,543 | 5/1941 | Phipps | 15/147 |
| 2,743,471 | 5/1956 | Forrester | 15/228 |
| 3,115,730 | 12/1963 | Churchill | 15/230.15 |
| 3,663,981 | 5/1972 | Du Crest et al. | 15/228 |
| 3,924,288 | 12/1975 | Breland | 15/225 |
| 4,951,341 | 8/1990 | Shears | 15/147.1 |
| 5,199,130 | 4/1993 | Lazar | 15/147.1 |

FOREIGN PATENT DOCUMENTS

| | | | |
|---|---|---|---|
| 473553 | 1/1915 | France | 15/210.1 |
| 501687 | 11/1954 | Italy | 15/230.15 |
| 297923 | 6/1954 | Switzerland | 15/230.15 |

*Primary Examiner*—David Scherbel
*Assistant Examiner*—Tony G. Soohoo

[57] ABSTRACT

A brushing implement is formed from flattened pleated multiple layers clamped on a line perpendicular to the pleats and having the troughs of the pleats of each layer converted into crests generally facing the corresponding crests converted from troughs on the other side. When this is performed, the layers are 'fluffed out' and form a partial cylindrical or ovoid shape.

11 Claims, 6 Drawing Sheets

BRUSH

This invention relates to a device which operates as a brush. That is, it is designed for loosening dirt on surfaces, but it does not use the bristles normally associated with a brush. Nor is it designed to absorb liquid in the manner of a mop.

It is noted that conventional bristle brushes have difficulty removing dirt from inside angles such as are found at the corners of shower enclosures, some bathtubs and at the junction of a bathtub and a tile surface. This is because a normally shaped bristle envelope has difficulty reaching the apices of said inside angles. A specially shaped bristle envelope may reach the inside angle apex for which it was designed but does not work effectively on flat surfaces or those inside angles of other shapes. Moreover conventional brushes do not normally operate well at the end of a 'broom handle'. Thus, with a conventional brush on a handle a bathtub may not be effectively scrubbed standing up. Normally with a conventional brush it is necessary to grasp the brush in the hand and kneel to scrub.

By 'handle' I mean a longitudinally extending rod of wood or metal which, in relevant applications, would be called a 'broom handle' or 'mop handle'.

There is now provided a novel form of pleated material which can provide the scrubbing action of a brush. It has the ability to work effectively in narrow recesses and inside angles, as well as on level surfaces. It is also able to perform effectively on the end of a handle, so that an article such as a bathtub may be scrubbed standing up.

In accord with the invention, material usually woven, and with qualities easier to describe hereafter, is arranged in layers (usually 5 or 6) of strips having a common longitudinal extension direction, attached along a line intermediate the edges of the strips which are formed into layers. The attached layers are then, over a length, formed with accordian pleats, whose fold lines are transverse to the longitudinal direction. The pleats are flattened toward near parallelness to the longitudinal direction. Until clamping they may be held manually or otherwise along an approximately central line intermediate the edges.

The pleated layers are then clamped by clamp means which define clamp lines extending in the longitudinal direction intermediate the edges.

The clamped pleats are thought of as defining an side facing in an application direction perpendicular to the pleat fold lines and to the longitudinal direction of the folded layers. The pleat for description purposes is described of as forming inner troughs and outer crests. The troughs of each successive pleat and length starting with the outer layer in the application direction, are on each side of the attachment line, pulled or converted from their pleated position, in the application direction and thus rotated (in the case of the outer layer) just less than 90° about the attachment line so that the former trough becomes a crest facing a similar crest on the other side of the attachment line. In succeeding layers the troughs become crests facing the previously converted layer. As successive layers are treated in the same manner the successive rotations about the attachment line become increasingly less than 90° so that the material of the layers, whose undulative edges forms an envelope which forms something more than a semicircle about the axis. In each case the material is preferably converted until restrained by the clamp means or a previous layer. If desired the material may be trimmed to give the envelope ovoid 'fluffed' shape.

The material (preferably woven nylon fabric) is selected to sustain its 'fluffed' shape. As so selected the material has a limited resiliency allowing it to return to its fluffed envelope shape after deformation by a brushing action.

To improve the brushing action, the material is preferably provided with a mildly abrasive surface which is effective also at the irregular edges of the fabric. Such abrasive surface will, of course, be selected to avoid damage to the surface on which it is used, such as a bathtub or tile glaze.

In the preferred embodiment the nylon netting of the material is provided with a resin coating. The combination of the resin coating, and the weave provides the desired abrasive effect. Of course other materials and or other abrasives may be used.

The most common use of the device will be mounted on a handle. Thus, the pleats are 'fluffed' in a direction perpendicular to the longitudinal line and to the pleat fold lines. This will be called the application direction that is the direction the device is applied to a cleaning surface. The handle will be attached to the clamping means to project therefrom in the opposite to the application direction. With the handle so attached, a bathroom or shower stall may usually be cleaned while the user is standing up. The material and its edges will usually clean to the roots of inside corners. Where necessary the cleaning effect may be increased by twirling the device by twirling the handle about its axis. The ability to clean standing up adds greatly to the comfort of the operator.

Preferably the material is non-absorbent. The device acts as a brush and not as a mop. The lack of liquid absorption allows it to better retain its shape and to improve the brushing action.

In drawings which illustrate a preferred embodiment of the invention:

Figure 3:
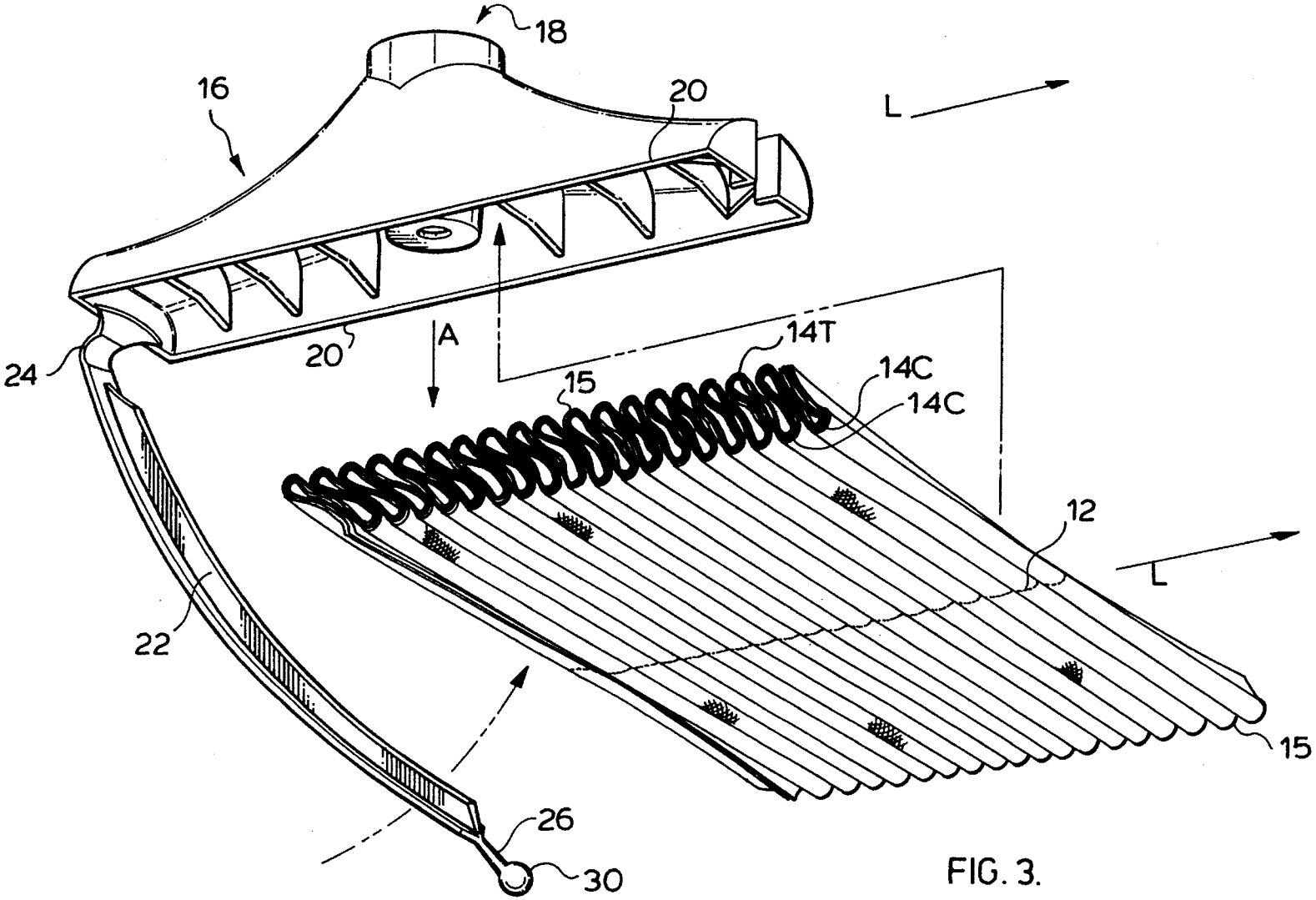
Figure 4:
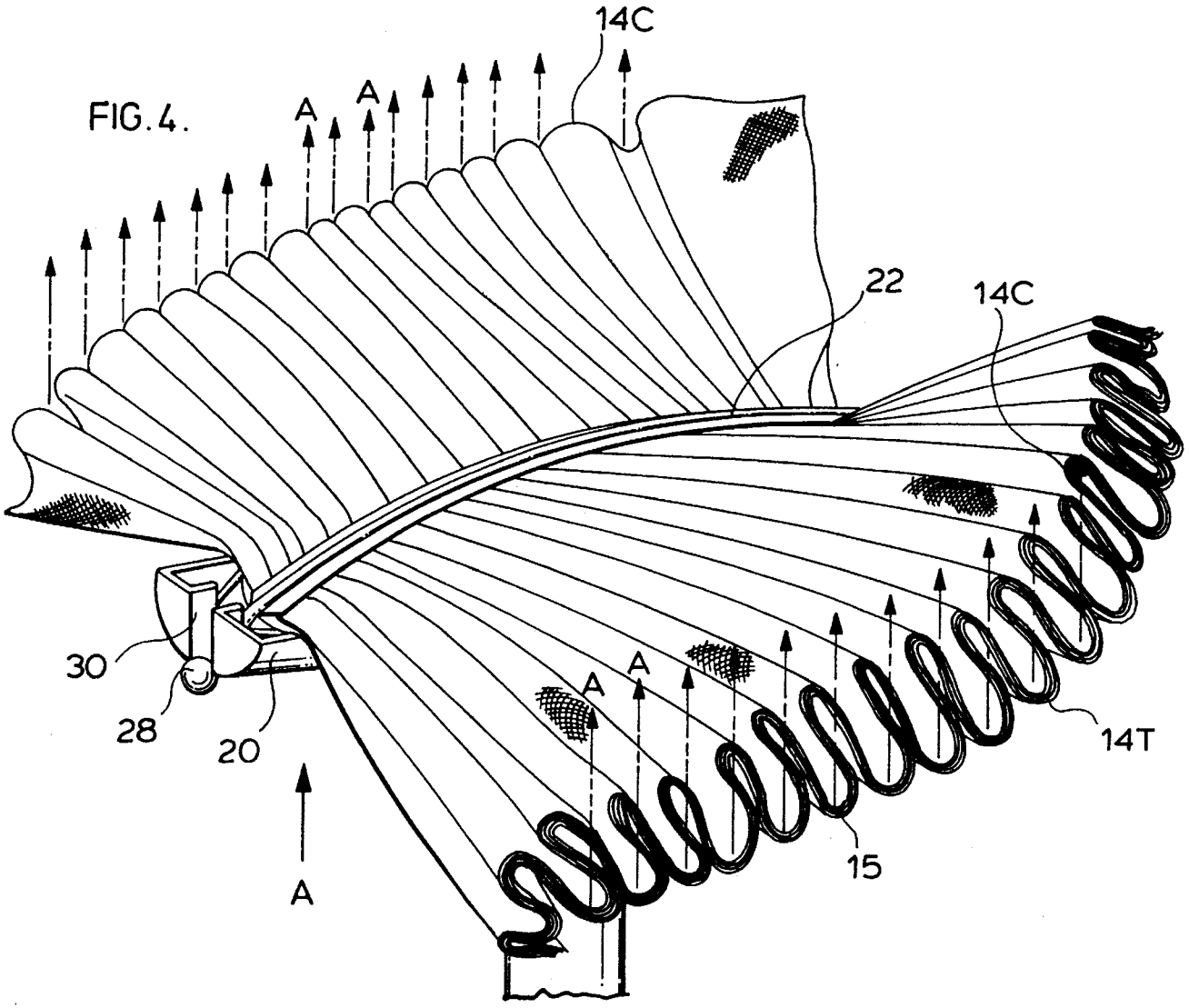
Figure 4A:
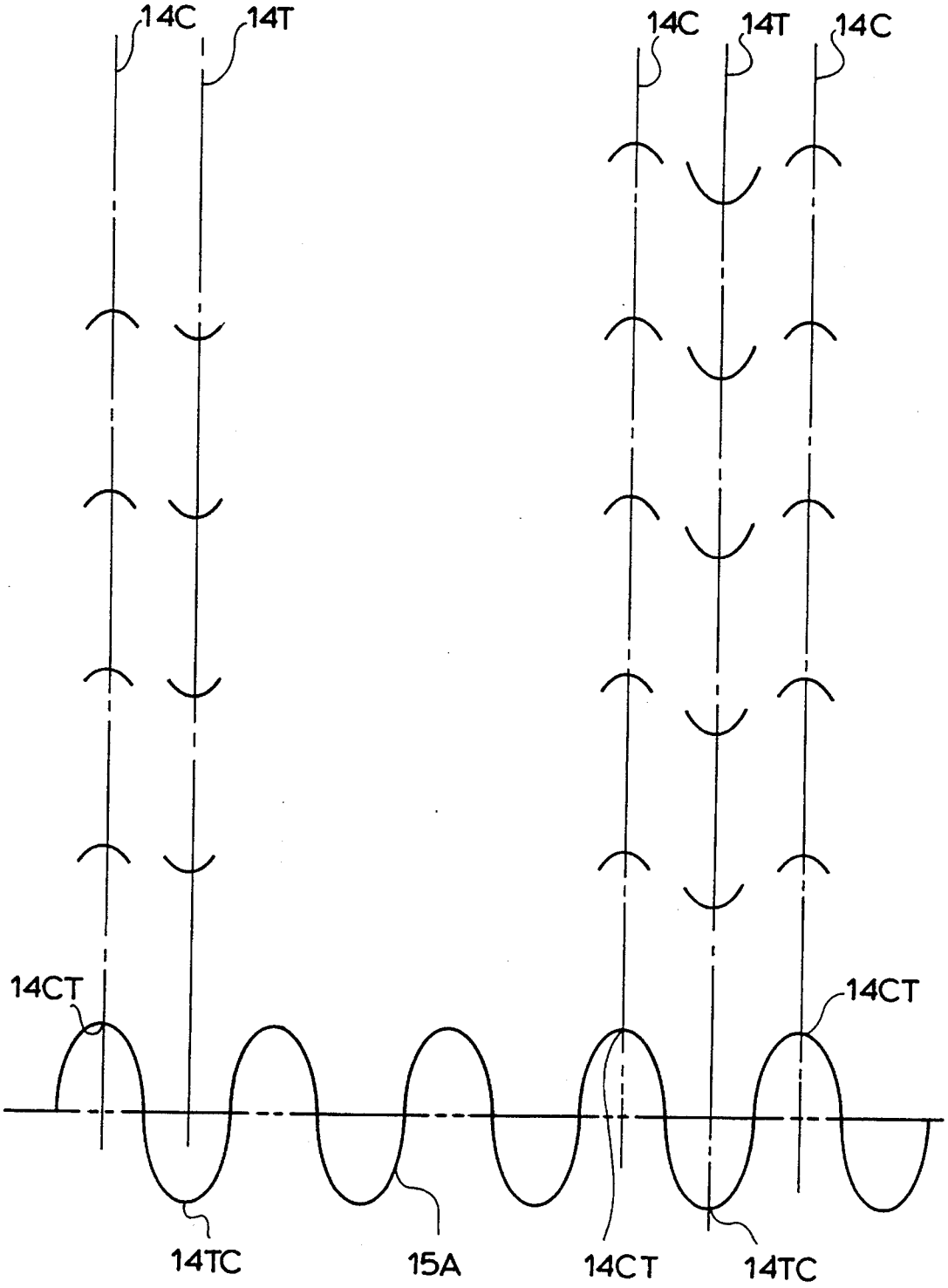
Figure 5:
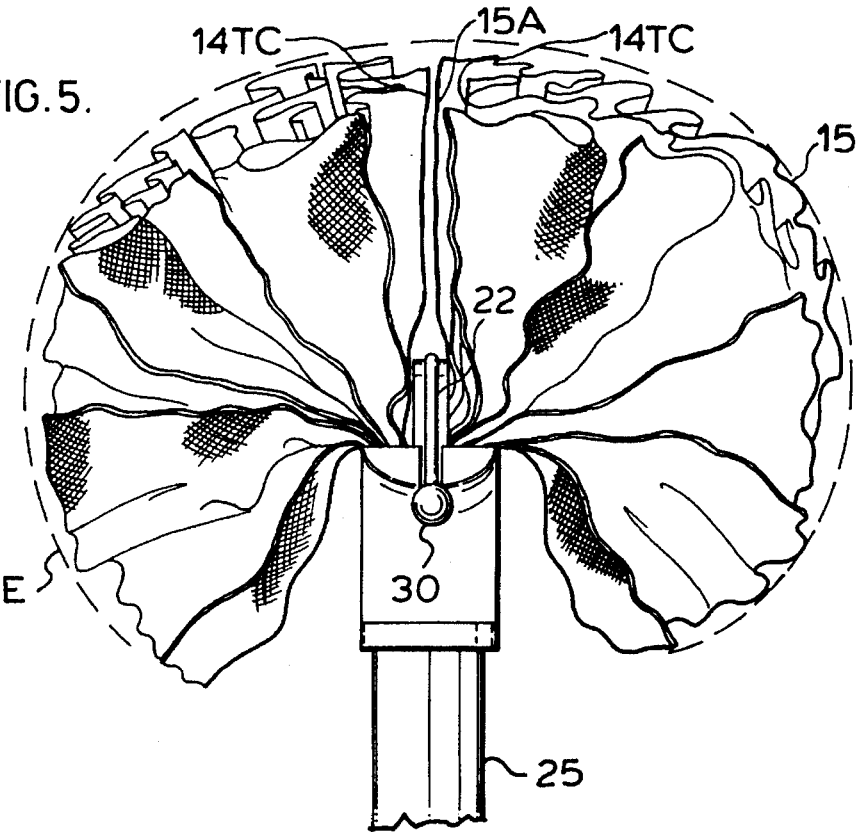
Figure 6:
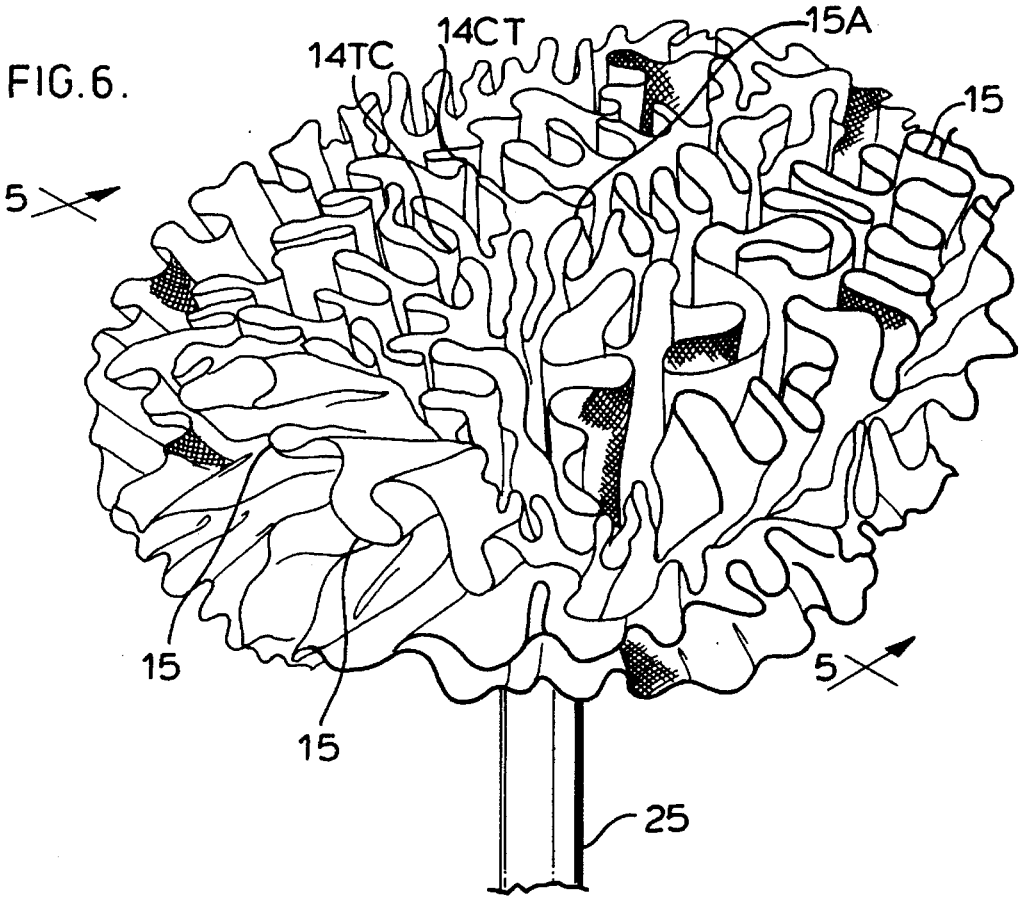
Figure 7:
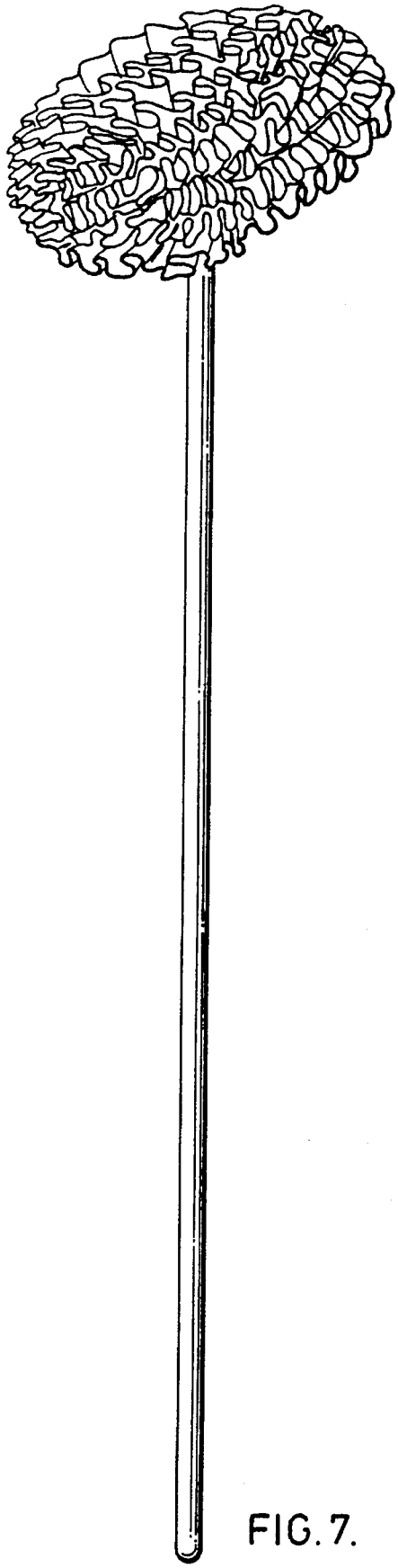

FIG. 3 demonstrates the clamping of the pleated layers,

FIGS. 4 and 4A schematically indicate the conversion of pleated troughs to crests in rotation about the attachment line, FIG. 5 is a section along the lines 5—5 of FIG. 6, FIG. 6 is a perspective of the envelope of the converted pleats, FIG. 7 is a perspective of a finished brush trimmed to ovoid shape.

In the drawings there are provided the desired (preferably 6) layers 10 of material in strip form. I prefer to use open weave nylon netting, which is resin coated and which I purchase from Novak Sales Corporation 381 Sunrise Hwy. Lynbrook, N.Y. 11563, U.S.A.

The strips 10 each define a longitudinal extension direction L and a median line 12 extending in such direction.

With the strips arranged so that the median lines overlie each other, I stitch along a line intermediate the edges (preferably along the common median lines 12). The purpose of such stitching is to hold the layers in relative position for the operations to follow. Thus it would be theoretically possible to dispense with this stitching if the layers could otherwise be maintained in their relative position.

Figure 1:
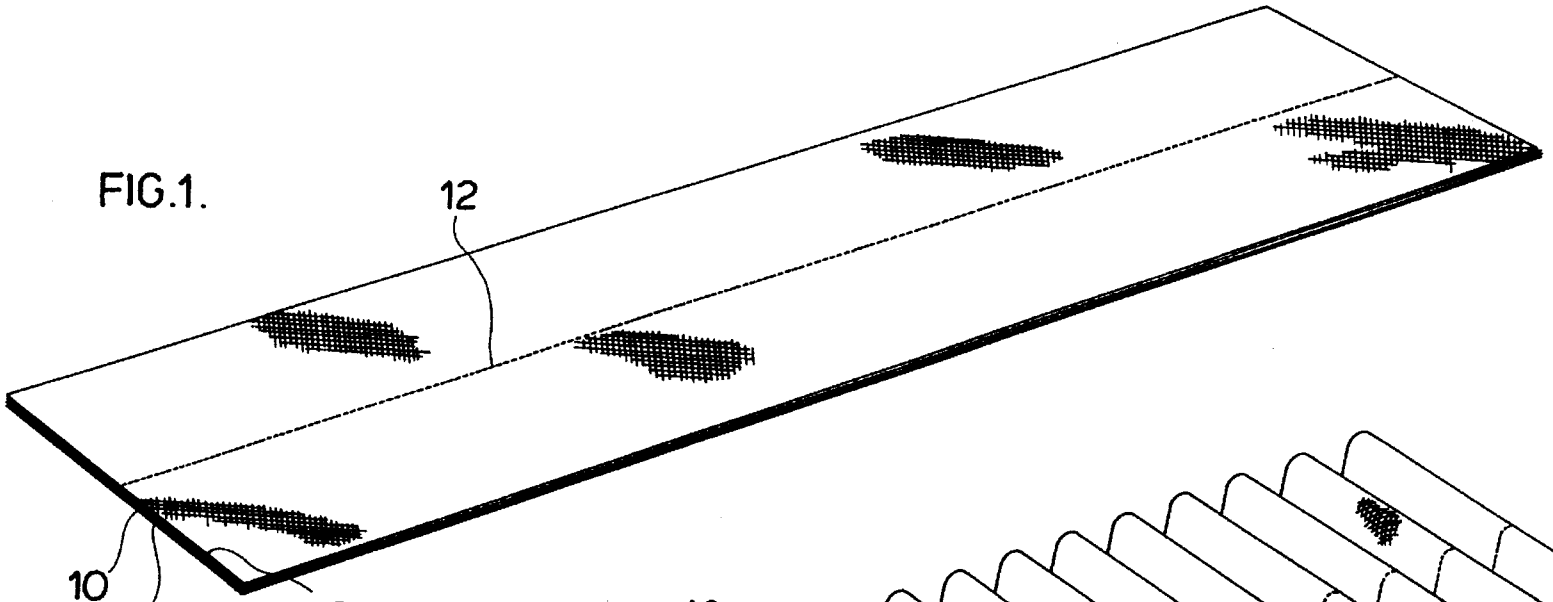
FIG. 1 shows stitched layers.
Figure 2:
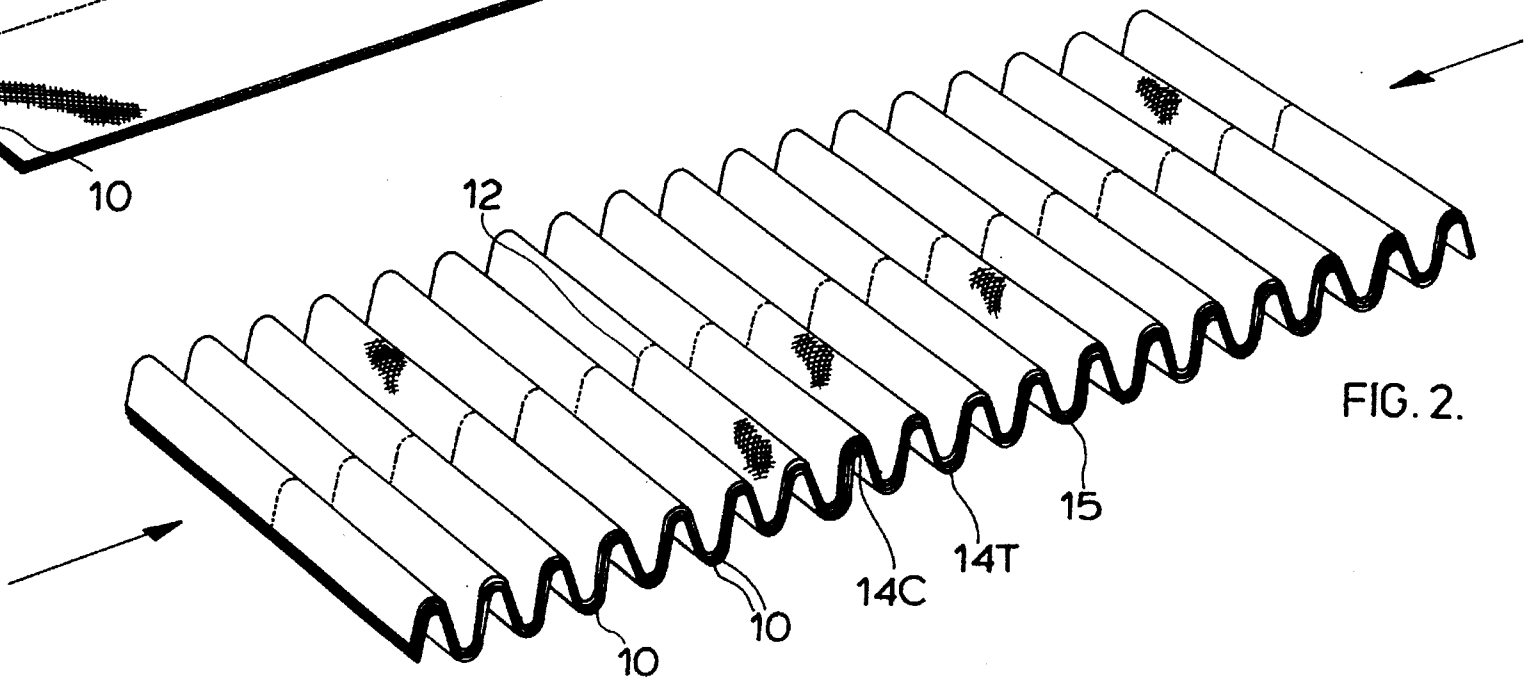
FIG. 2 shows pleats being formed in the layers of FIG. 1.

The stitched layers are then provided with accordion pleats as shown in FIG. 2, where the fold lines 14C and 14T of the pleats run transverse to the longitudinal direction.

With the pleated material flattened, as indicated in FIG. 3, so that the material of the pleats is almost parallel to the longitudinal direction, the pleats will be clamped between a base and an attachable fastening arm. I have found that the pleats may be held flattened manually (the operators hands are not shown) although some dexterity is require If desired the flattened pleats may again be stitched (not shown) along a line parallel to direction L, to maintain them in this arrangement until clamped.

The clamping means 15 comprises a holder 16 having a socket 18 extending in the opposite to the extension direction A and parallel edges 20 facing in direction A and defining a recess between them. A clamping strip 22 is clamped by a living hinge 24 and, at its free end has extension 26 with ball 28 which will seat the extension in slot 30 of the clamping means to hold the flattened pleats in place. Any other clamping means may be used.

With the clamp applied, there is defined an application direction A perpendicular to the longitudinal direction and (roughly) perpendicular to the fold lines of the pleats.

The 'fluffing' of the clamped material is described with regard to the perspective FIG. 4 and to the idealized schematic view of FIG. 4A.

The clamped, pleated, material is 'fluffed' by taking the outer layer of the material in the application direction A at one edge 15 and grasping the pleat material at the inner fold line 14T and pulling such material out of the pleat then forward in the application direction overall in direction A. This pulling is continued until the material is held against further travel by the clamp means edges 20. The displaced fabric will form as demonstrated in FIG. 4A from troughs 14T a series of crests 14TC which will face crests 14TC formed from the crests and troughs of the same layer, (not shown) on the other side of clamping bar 22. The same manipulation (not demonstrated) will be performed with the next layer so that the troughs are converted to crests nearer the displaced outer layer. While a section of the outer layer taken perpendicular to the longitudinal axis will be almost parallel to the application direction A (see lines 15A in FIGS. 4A, 5 and 6); the next layer, which in the 'fluffing' conversion is folded about the outer layer, and is angularly further from the direction A. This angular deflection increases with each layer and thus the fluffed layer edges define a partial cylindrical envelope see dotted line E (FIG. 5) which is somewhat larger than a semi cylinder, in section.

The brush, if used without a handle is ready to use. It will usually be desired to use a handle and the clamping means is provided with threaded socket 18 to receive the complementary threaded wooden or plastic handle 25.

The envelope of the fluffed edges is an approximate partial cylinder. If desired this may be trimmed at the ends to form an elongated ovoid shape. The ovoid shape is best shown in FIG. 7.

Since the material of the device is non absorbent the device acts as a brush rather than a mop. The edges 15 of the pleated and fluffed material achieve better penetration of narrow inside corners than bristle brushes. Thus a bathtub or shower stall may be cleaned by the device with a handle 25 attached, so that the user may perform the brushing action standing up rather than kneeling. The user may use either brush strokes or a twirling action about the axis of the broom 25 to achieve the cleaning action by edge 15 in inside corners and recesses.

I claim:

1. The method of constructing a brushing implement comprising:

forming a multiple layer of strips each extending generally in a longitudinal direction, said layer of strips having an outer layer and successive adjacent layers, attaching said layer of strips together along a line generally parallel to said longitudinal direction and intermediate the respective edges of said strips gathering said layers into gathered pleats extending generally perpendicular to said longitudinal direction and, clamping said gathered pleats by a clamping means extending generally parallel to said longitudinal direction so that said gathered pleats extend on each side of said clamping means, said pleats thereby defining a plurality of first crests and first troughs in each of said layers, converting each of said first crests and first troughs on said outer layer respectively into second troughs and second crests, and successively converting each of said first crests and first troughs of each successive adjacent layer into second troughs and second crest respectively.

2. The method as claimed in claim 1 including the step of connecting to said clamping means a longitudinally extending handle.

3. A brushing implement comprising:

a plurality of strips of material extending in a longitudinal direction, said strips being joined together in a longitudinal attachment line intermediate the edges of said strips to form a plurality of layers, a clamping means extending generally in said longitudinal direction of said strips thereby clamping and gathering said layers in a gathered pleated fashion, said clamping means defining within each of said layers, a first clamped portion of a plurality of clamped first crests and first toughs and whereby each of said layers further having a respective portion of a plurality of unclamped second crests and second troughs on each side of said clamping means whereby, each of said second crests and second troughs extending respectively from a respective clamped first trough and first crest.

4. Brushing implement as claimed in claim 3 wherein said material has a limited resiliency.

5. Brushing implement as claimed in claim 4 wherein said material has an abrasive coating.

6. Brushing implement as claimed in claim 5 wherein said material is substantially non-absorbent to liquid.

7. Brushing implement as claimed in claim 4 wherein said material is substantially non-absorbent to liquid.

8. Brushing implement as claimed in claim 3 including a longitudinally extending handle extending from said clamping means.

9. Brushing implement as claimed in claim 3 wherein said material has an abrasive coating.

10. Brushing implement as claimed in claim 9 wherein said material is substantially non-absorbent to liquid.

11. Brushing implement as claimed in claim 3 wherein said material is substantially non-absorbent to liquid.

* * * * *